US005220930A

United States Patent [19]

Gentry

[11] Patent Number: 5,220,930

[45] Date of Patent: Jun. 22, 1993

[54] CIGARETTE WITH WRAPPER HAVING ADDITIVE PACKAGE

[75] Inventor: Jeffery S. Gentry, Pfafftown, N.C.

[73] Assignee: R. J. Reynolds Tobacco Company, Winston-Salem, N.C.

[21] Appl. No.: 842,276

[22] Filed: Feb. 26, 1992

[51] Int. Cl.[5] ..... A24D 1/02

[52] U.S. Cl. ..... 131/365; 131/331

[58] Field of Search ..... 131/360, 331, 362, 365, 131/373, 374

[56] References Cited

U.S. PATENT DOCUMENTS

| | | | |
|---|---|---|---|
| 1,879,128 | 9/1932 | Desper . | |
| 2,171,986 | 9/1939 | Poetschke | 131/36 |
| 2,886,041 | 5/1959 | Harwood | 131/15 |
| 2,886,042 | 5/1959 | Hoover | 131/15 |
| 2,992,647 | 7/1961 | Figge | 131/9 |
| 3,030,963 | 4/1962 | Cohn | 131/4 |
| 3,044,924 | 7/1962 | Schur | 162/139 |
| 3,640,285 | 2/1972 | Briskin et al. | 131/2 |
| 3,667,479 | 6/1972 | Sanford et al. | 131/15 |
| 3,699,972 | 10/1972 | Frisch | 131/9 |
| 3,722,515 | 3/1973 | Reynolds | 131/15 B |
| 3,797,504 | 3/1974 | Hughes et al. | 131/15 B |
| 3,908,671 | 9/1975 | Cogbill, II | 131/15 R |
| 4,044,778 | 8/1977 | Cohn | 131/4 A |
| 4,129,134 | 12/1978 | Hind et al. | 131/2 |
| 4,230,131 | 10/1980 | Simon | 131/4 A |
| 4,231,377 | 11/1980 | Cline et al. | 131/9 |
| 4,420,002 | 12/1983 | Cline | 131/334 |
| 4,433,697 | 2/1984 | Cline et al. | 131/365 |
| 4,450,847 | 5/1984 | Owens | 131/365 |
| 4,453,553 | 6/1984 | Cohn | 131/365 |
| 4,461,311 | 7/1984 | Mathews et al. | 131/365 |
| 4,561,454 | 12/1985 | Guess . | |
| 4,622,983 | 11/1986 | Mathews et al. . | |
| 4,624,268 | 11/1986 | Baker et al. | 131/365 X |
| 4,721,120 | 1/1988 | Greig et al. | 131/365 |
| 4,784,164 | 11/1988 | Adams et al. | 131/365 |
| 4,805,644 | 2/1989 | Hampl, Jr. et al. . | |
| 4,881,557 | 11/1989 | Martin . | |
| 4,915,118 | 4/1990 | Kaufman . | |
| 4,924,888 | 5/1990 | Perfetti et al. | 131/365 X |
| 4,941,485 | 7/1990 | Perfetti et al. . | |
| 5,050,622 | 9/1991 | Raker et al. | 131/365 |
| 5,060,675 | 10/1991 | Milford . | |
| 5,065,777 | 11/1991 | Owens . | |
| 5,085,232 | 2/1992 | Raker . | |
| 5,105,838 | 4/1992 | White et al. | 131/365 |

FOREIGN PATENT DOCUMENTS

| | | |
|---|---|---|
| 290911 | 11/1988 | European Pat. Off. . |
| 249932 | 12/1969 | U.S.S.R. . |
| 249933 | 12/1969 | U.S.S.R. . |

*Primary Examiner*—V. Millin
*Assistant Examiner*—William M. Pierce

[57] ABSTRACT

A cigarette includes a charge or roll of smokable material (e.g., tobacco cut filler) circumscribed by at least one layer of paper wrapping material to form a tobacco rod. A certain cigarette includes an outer wrapping material which circumscribes and overwraps an inner wrapping material. At least one paper wrapping material of the tobacco rod includes an additive package. The additive package includes at least one water soluble salt which is applied in a water soluble form. For example, a paper wrapper including wood pulp fiber and calcium carbonate filler material is treated with an aqueous solution of calcium acetate, potassium chloride and potassium acetate. The cigarette is capable of sustaining smolder under FTC smoking conditions while yielding very low levels of visible sidestream smoke.

79 Claims, 2 Drawing Sheets

CIGARETTE WITH WRAPPER HAVING ADDITIVE PACKAGE

BACKGROUND OF THE INVENTION

The present invention relates to cigarettes which burn tobacco, and in particular to cigarettes, which when smoked, generate low amounts of sidestream "tar" and sustain smolder at least during FTC smoking conditions.

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element includes cellulose acetate tow circumscribed by plug wrap, and is attached to the tobacco rod using a circumscribing tipping material. It also has become desirable to perforate the tipping material and plug wrap, in order to provide dilution of drawn mainstream smoke with ambient air.

Cigarettes are employed by the smoker by lighting one end thereof and burning the tobacco rod. The smoker then receives mainstream smoke into his/her mouth by drawing on the opposite end (e.g., the filter end) of the cigarette. During the time that the cigarette is not being drawn upon by the smoker, it remains burning, and sidestream smoke is generated. Sidestream smoke is smoke which directly enters the atmosphere from the lit end of the cigarette. Sidestream smoke diffuses into the atmosphere, and the characteristic visible nature thereof may be perceived negatively by some individuals. Thus, certain cigarette smokers have indicated a desire to decrease the levels of visible sidestream smoke generated by their cigarettes.

The relative amount of visible sidestream smoke generated by a burning cigarette is related to the amount of sidestream "tar" generated by that burning cigarette. Typical cigarettes of about 84 mm length (e.g., having a tobacco rod length of about 57 mm and a filter element length of about 27 mm) often yield about 25 to about 35 mg of sidestream "tar" per cigarette. See, Proctor, et al., *Analyst,* Vol. 113, p. 1509 (1988), for an apparatus and technique for determining the sidestream "tar" of a cigarette.

Numerous cigarettes which reportedly yield relatively low levels of visible sidestream smoke have been proposed. See, for example, U.S. Pat. Nos. 4,108,151 to Martin; 4,225,636 to Cline; 4,231,377 to Cline; 4,407,308 to Baker; 4,420,002 to Cline; 4,450,847 to Owens; 4,461,311 to Mathews; 4,561,454 to Guess; 4,624,268 to Baker, et al.; 4,637,410 to Luke; 4,805,644 to Hampl, Jr., et al.; 4,881,557 to Martin; 4,915,118 to Kaufman, et al.; 4,924,888 to Perfetti, et al.; 4,941,485 to Perfetti, et al.; 4,998,541 to Perfetti, et al.; 5,060,675 to Milford et al; and 5,065,777 to Owens, Jr.; as well as European Patent Application No. 402,059 and U.S. Pat. application Ser. Nos. 661,747, filed Feb. 27, 1991 and 759,266 filed Oct. 3, 1991.

It would be desirable for the Cigarette manufacturer to provide a good tasting cigarette which is capable of (i) providing good smoking satisfaction, (ii) sustaining smolder at least during FTC smoking conditions, (iii) generating low levels of sidestream "tar" and hence low levels of visible sidestream smoke, and (iv) exhibiting desirable performance attributes (e.g., exhibiting a strong, cohesive ash) during the smoking period.

SUMMARY OF THE INVENTION

The present invention relates to a cigarette which delivers good tobacco smoking flavor, pleasure and satisfaction, while being capable of generating relatively low levels of sidestream "tar." Preferred cigarettes exhibit extremely low levels of visible sidestream smoke as well as low levels of sidestream odor. Cigarettes of the present invention (i) have a weight which is not overly excessive, (ii) yield an acceptable ash and fire cone, (iii) yield acceptable smolder properties, and (iv) yield a burn rate and puff count which are acceptable. Further, such cigarettes have a tendency to (i) burn back uniformly during use, and (ii) not provide visible staining of the outer wrap immediately behind the char line during use, and (iii) yield an ash of acceptable color. Preferred cigarettes burn back slowly during static smolder resulting in the combustion of a relatively low amount of smokable material, while maintaining a tendency to sustain smolder.

Certain cigarettes of the present invention include a charge or roll of smokable material contained in a circumscribing wrapping material to form a so-called "tobacco-rod". The smokable material is a smokable filler material comprising tobacco cut filler. Normally, the smokable material is all tobacco cut filler material, and preferably that cut filler material has been cased and/or top dressed. The wrapping material is a paper which includes a water soluble additive package (i.e., the additive package includes water soluble components). The additive package is in intimate contact with the wrapping material. The amount of additive package in intimate contact with the wrapping material typically ranges from about 5 to about 40 percent, based on the final dry weight of the wrapping material including the additive package. The additive package includes at least one water soluble alkali earth metal ion component. The additive package most preferably includes at least one water soluble alkali metal ion component. The additive package includes at least one water soluble organic anion component. The additive package most preferably includes at least one water soluble inorganic anion component. Most preferably, the water soluble alkali earth metal ions and the organic anions provide the primary components of the additive package. If desired, other components in addition to the additive package can be incorporated into the wrapping material. For example, flavor and aroma precursors, flavoring agents, organic acids, and the like, also can be incorporated into the wrapping material.

A highly preferred additive package includes (i) optional alkali metal ions and (ii) alkali earth metal ions, such that the ratio of equivalents of (i) to (ii) ranges from about 0 to about 1.2, typically about 0.05 to about 1, often about 0.1 to about 0.7, and frequently about 0.2 to about 0.5. A highly preferred additive package also includes (iii) optional inorganic anions and (iv) organic anions, such that the ratio of equivalents of (iii) to (iv) ranges from about 0 to about 1, typically about 0.05 to about 0.7, often about 0.1 to about 0.5, and frequently about 0.1 to about 0.3. In addition, for an additive package, the total number of equivalents of (i) plus (ii) equals the total number of equivalents of (iii) plus (iv). As used herein, the term "equivalents" means the number of moles of a component ion multiplied by the charge of that component (e.g., the charge of a calcium ion is 2 and the charge of an acetate ion is 1).

By "water soluble" in referring to the components of the additive package is meant that the components of the package form a thermodynamically stable mixture when combined with an aqueous liquid, have a significant ability to dissolve in an aqueous liquid, and do not form precipitates to any significant degree when present in an aqueous liquid. The water soluble package can be provided by dissolving suitable salts in an aqueous liquid, and/or by neutralizing corresponding acids and bases in an aqueous liquid. Particularly desirable salts are those that have a solubility in water of greater than about 10 weight percent at 25° C. As used herein, the term "water soluble" in referring to the components of the additive package is meant that the components are in a water soluble form (i.e., as opposed to an essentially water insoluble precipitate) at least until the point at which those components are applied to, are incorporated into, or are otherwise provided in intimate contact with the wrapping material. As such, it is possible that water soluble components can take an essentially water insoluble form once those components are incorporated into the wrapping material (i.e., certain precipitates comprising at least one of the components of the additive package can form after the components of the additive package are applied to the wrapping material). However, it is most desirable that a majority by weight of the components of the additive package remain in a water soluble form (i.e., as water soluble salts) while those components are in intimate contact with the wrapping material, during the useful lifetime of the wrapping material (i.e., during the period up until the time that a cigarette incorporating that wrapping material, stored and handled under normal conditions, is smoked).

Certain cigarettes of the present invention include a charge or roll of smokable material contained in two layers of circumscribing outer wrapping materials to form a tobacco rod. The tobacco rod is such that a first (i.e., inner) wrapping material circumscribes the smokable material, and a second (i.e., outer) wrapping material circumscribes the first wrapping material. One or both of the wrapping materials can be a paper incorporating the additive package of the type previously described. The smokable material is a smokable filler material comprising tobacco cut filler material. Normally, the smokable material is all tobacco cut filler material, and preferably that cut filler material has been cased and/or top dressed.

The second or outer layer of wrapping material surrounding the roll of smokable material preferably is a paper incorporating the additive package of the type previously described. The second wrapping material incorporating the additive package most desirably has a moderate to relatively low inherent air permeability. Certain wrapping materials incorporating the additive package exhibit a porosity or air permeability below about 30 CORESTA units, normally below about 25 COESTA units, often below about 20 CORESTA units, frequently below about 15 CORESTA units, and even about 10 CORESTA units or less. A CORESTA unit is a measure of the linear air velocity which passes through a 1 cm²area of wrapper at a constant pressure of 1 centibar. See CORESTA Publication ISO/TC 0126/SC I N159E (1986). The second wrapping material can have a net porosity which is greater than the inherent porosity thereof. For example, the second wrapping material can be perforated (e.g., electrostatically perforated) to have a net porosity of about 50 to about 225 CORESTA units.

The first or inner wrapping material surrounding the roll of smokable material is a paper, and most preferably a paper that is different in composition from the outer wrapping material. The paper can vary, but one preferred paper is a paper containing a tobacco material. Certain first wrapping materials which contain a tobacco material, preferably have a sufficiently high level of at least one salt additive which can act to sustain static burn of the tobacco rod, at least when such cigarettes are smoked under FTC smoking conditions. The salt can be an essentially water insoluble inorganic salt (e.g., particles of calcium carbonate), a water soluble inorganic salt (e.g., potassium chloride), or a water soluble organic salt (e.g., potassium citrate). Mixtures of essentially water insoluble and water soluble salts can be employed. In certain circumstances, the inner wrapping material can incorporate the additive package of the type previously described. Certain inner wrapping materials can contain a carbonaceous material. The first wrapping material most preferably exhibits an inherent air permeability above about 20 CORESTA units. The first wrapping material can be perforated to yield a wrapping material having yet higher net porosity.

Cigarettes of the present invention preferably each include a filter element which acts as a mouthpiece.

Cigarettes can be air diluted (e.g., by perforating the tipping material in the region which overlies the filter elements or by other such air dilution means). Normally, preferred cigarettes employ moderate to low efficiency filter elements. See, Keith in Schemeltz's *The Chemistry of Tobacco and Tobacco Smoke, p.* 157 (1972). Normally, the filter element is ventilated to provide a cigarette having an air dilution between about 25 and about 75 percent. As used herein, the term "air dilution" is the ratio (expressed as a percentage) of the volume of air drawn through the air dilution means to the total volume of air and smoke drawn through the cigarette and exiting the extreme mouthend portion of the cigarette. See, Selke, et al., *Beitr. Zur Tabak. In.*, Vol. 4, p. 193 (1978).

DETAILED DESCRIPTION OF THE PREFERRED EMBODIMENTS

Figure 1:
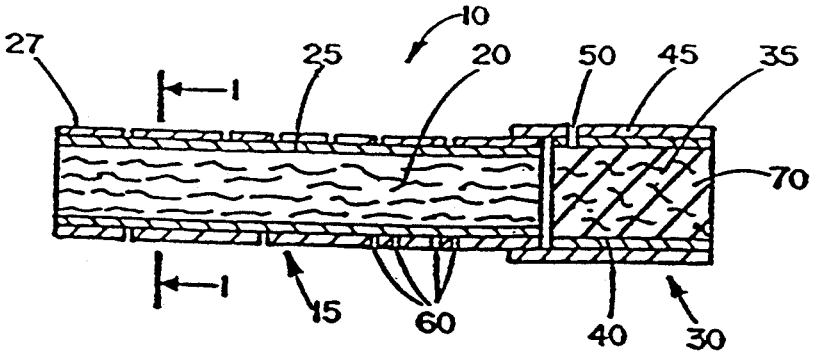
FIG. 1 is a longitudinal sectional view of a cigarette of the present invention.

An embodiment of a cigarette of the present invention is shown in FIG. 1. The cigarette 10 includes a generally cylindrical rod 15 of a column of smokable material 20, such as tobacco cut filler, contained in a first circumscribing inner wrapping material 25 and a second or outer wrapping material 27 circumscribing the first wrapping material. The first and second circumscribing wrapping materials directly contact one another (i.e., the inner surface of the outer wrapping material contacts the outer surface of the inner wrapping material). As such, the outer wrapping material overwraps the inner wrapping material. The rod 15 is hereinafter referred to as a "tobacco rod." The ends of the tobacco rod 15 are open to expose the smokable material. The outer wrapping material 27 most preferably includes an additive package which is described in greater detail hereafter. If desired, the inner wrapping material 25 can include an additive package which is described in greater detail hereafter. Although the additive package of the inner wrapping material 25 is optional, and not particularly preferred, inner wrapping material incorporating an additive package can be employed with an outer wrapping material which either includes or is absent of an additive package.

The cigarette 10 also includes a filter element 30 positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The filter element includes a filter material (e.g., triacetin plasticized cellulose acetate tow) 35 circumscribed by a paper plug wrap 40. The ends of the filter element are open to permit the passage of air and smoke therethrough.

The filter element 30 is attached to the tobacco rod 15 by tipping material 45 which circumscribes both the entire length of the filter element and an adjacent region of the tobacco rod. The inner surface of the tipping material 45 is fixedly secured to the outer surface of the outer plug wrap 40 and the outer surface of the wrapping material 25 of the tobacco rod, using a suitable adhesive. A ventilated or air diluted smoking article is provided with an air dilution means, such as a series of perforations 50, each of which extend through the tipping material and plug wrap.

Figure 2:
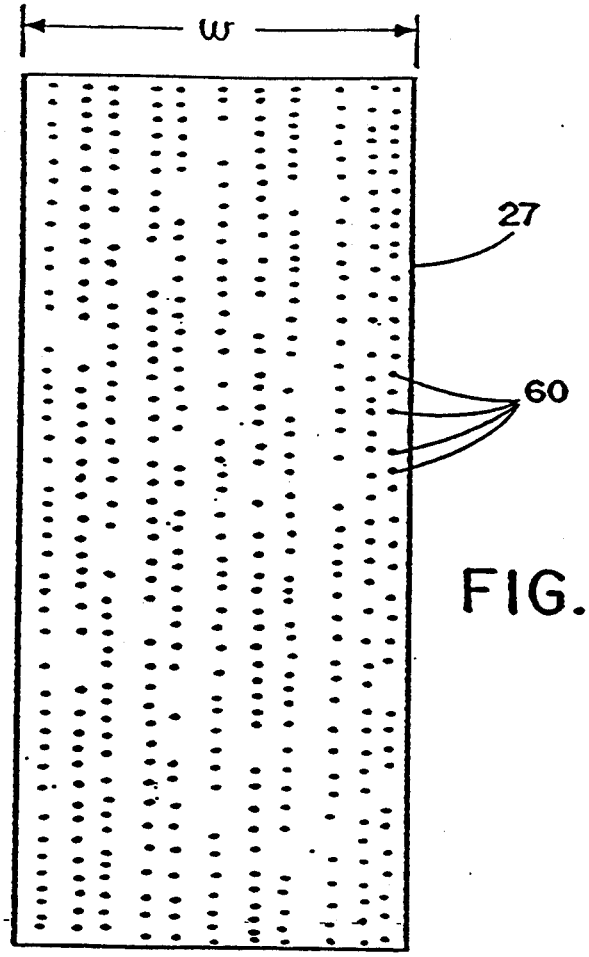
FIG. 2 is a diagrammatic illustration of one type of wrapping material which can be employed to provide a tobacco rod of the present invention.

Referring to FIGS. 1 and 2, one type of outer wrapping material 27 has a width w (shown in FIG. 2) which is equal to the circumference of the cigarette plus the lap zone of the glue line which ultimately results during cigarette manufacture. One type of second wrapping material 27 includes a series of perforations 60 which extend in a linear fashion along the longitudinal length of thereof. Alternatively, other configurations, such as a random perforation pattern, can be provided. The size, number and relative positioning of the individual perforations 60 can vary depending upon the desired characteristics of the cigarette which has the wrapping material incorporated therein. The individual perforations are shown as enlarged in FIGS. 1 and 2.

Figure 1A:
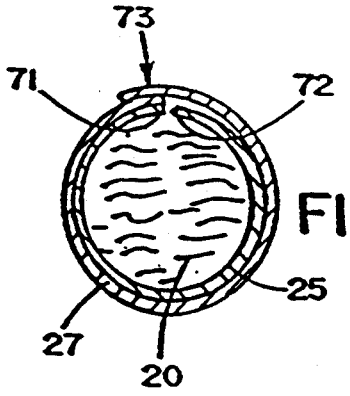
FIGS. 1A and 1B are cross-sectional radial views of the cigarette shown in FIG. 1 taken along lines 1—1 in FIG. 1.

Referring to FIG. 1A, smokable material 20 is contained in a first circumscribing inner wrapping material 25, and a second outer wrapping material 27 circumscribes the first wrapping material. The first wrapping material 25 is formed into a circular shape such that the ends 71, 72 of the sides thereof abut one another. The ends 71, 72 of wrapping material 25 can abut one another (as shown in FIG. 1A), nearly abut one another, or slightly overlap one another. The second wrapping material 27 includes a lap zone 73 including a suitable adhesive therebetween so as to form a secure outer wrapper. As such, the width of the inner wrapping material is less than that of the outer wrapping material. A cigarette rod having such a configuration can be provided by supplying paper wrappers from two bobbins on a suitably equipped cigarette making machine, positioning the inner wrapping material on top of the outer wrapping material, passing the two wrapping materials so positioned through the garniture region of the cigarette making machine, and forming the tobacco rod. Equipment for providing a cigarette in such a manner is described in U.S. Pat. application Ser. Nos. 609,975, filed Nov. 6, 1990, and 756,023, filed Sep. 6, 1991, which are incorporated herein by reference. Other equipment for manufacturing a cigarette in such a manner will be apparent to the skilled artisan.

Figure 1B:
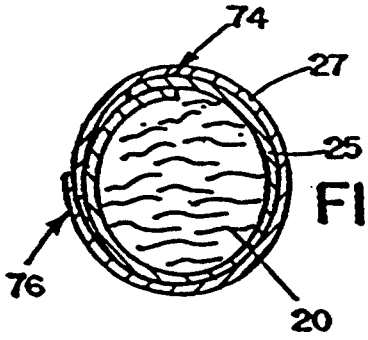

Referring to FIG. 1B, smokable material 20 is contained in a first circumscribing inner wrapping material 25, and a second outer wrapping material 27 circumscribes the first wrapping material. The first wrapping material 25 is formed into a circular shape such that a lap zone 74 including a suitable adhesive therebetween is formed. The second wrapping material includes a lap zone 76 including a suitable adhesive therebetween so as to form a secure outer wrapper. A cigarette rod having such a configuration can be provided by forming a cigarette rod using known techniques, and then wrapping the rod so formed with an outer wrapping material. Equipment for providing such a cigarette will be apparent to the skilled artisan.

Figure 3:
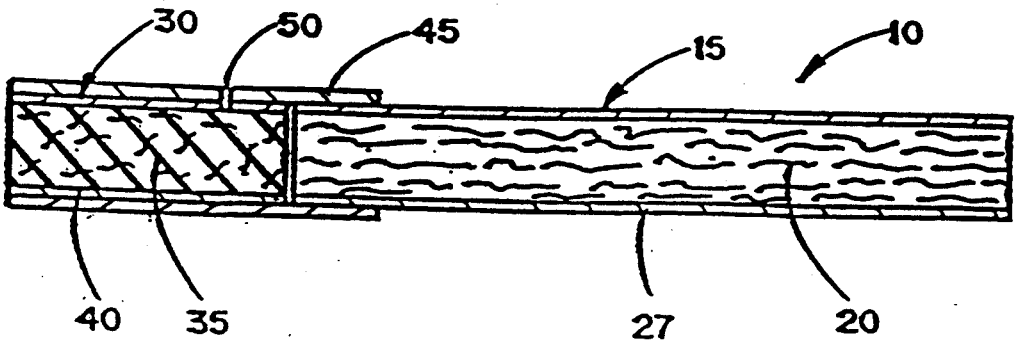
FIG. 3 is a longitudinal sectional view of a cigarette of the present invention.

Another embodiment of a cigarette of the present invention is shown in FIG. 3. The cigarette 10 is generally similar to the cigarette described with reference to FIG. 1, except that the tobacco rod 15 includes only one layer of circumscribing wrapping material 27 circumscribing the smokable material 20. The wrapping material 27 includes an additive package which is described in greater detail hereafter.

The smokable material employed in the manufacture of the tobacco rod can vary. For example, the smokable material of the cigarette can have the form of filler (e.g., tobacco cut filler). As used herein, the terms "filler" or "cut filler" are meant to include tobacco materials and other smokable materials which have a form suitable for use in the manufacture of tobacco rods for cigarettes. As such, filler can include smokable materials which are blended and are in a form ready for cigarette manufacture. The filler materials normally are employed in the form of strands or shreds as is common in conventional cigarette manufacture. For example, the cut filler material can be employed in the form of strands or shreds from sheet-like or "strip" materials which are cut into widths ranging from about 1/20 inch to about 1/60 inch, preferably from about 1/25 inch to about 1/35 inch. Generally, such strands or shreds have lengths which range from about 0.25 inch to about 3 inches.

Examples of suitable types of tobacco materials include flue-cured, Burley, Maryland or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. Certain reconstituted tobacco materials are described in U.S. Pat. Nos. 4,987,906 to Young, et al. and 5,056,537 to Brown, et al.; in European Patent Application No. 419,733; and in U.S. Pat. application Ser. Nos. 647,329, filed Jan. 28, 1991; and 710,273, filed Jun. 4, 1991. Certain processed tobacco materials are described in U.S. Pat. Nos. 5,025,812 to Fagg, et al.; and 5,065,775 to Fagg. Certain blends are described in U.S Pat. Nos. 4,924,888 to Perfetti, et al.; 4,942,888 to Montoya, et al.; and 4,998,541 to Perfetti, et al. Preferably, the smokable material or blend of smokable materials consists essentially of tobacco filler material or consists only of tobacco filler material.

Smokable materials can be cased and top dressed as is conventionally performed during various stages of cigarette manufacture. As such, the smokable material, and particularly tobacco filler material, can include casing and/or top dressing components. For example, blend components such as flavoring agents and humectants, as well as other forms of tobacco (e.g., tobacco extracts), can be applied to the smokable material, as is commonly performed when cigarettes are manufactured. See, Leffingwell, et al., *Tobacco Flavoring For Smoking Products* (1972). Suitable flavoring agents and forms of tobacco include vanillin, tobacco extracts such as tobacco essences and tobacco aroma oils, cocoa, licorice, menthol, and the like. Flavor modifying agents such as levulinic acid can be applied to the smokable material (e.g., in amounts ranging from about 0.01 to about 2 percent, normally from about 0.1 to about 1 percent, preferably about 0.2 to about 0.6 percent, based on the dry weight of the smokable material). Such components conveniently are applied to the smokable material as casing and top dressing components. See, U.S. Pat. No. 4,830,028 to Lawson, et al.

Typically, the tobacco rod has a length which ranges from about 35 mm to about 85 mm, preferably about 40 to about 70 mm; and a circumference of about 17 mm to about 27 mm, preferably about 22.5 mm to about 25 mm. Short cigarette rods (i.e., having lengths from about 35 mm to about 50 mm) can be employed, particularly when smokable blends having a relatively high packing density are employed.

The packing densities of the blend of smokable materials contained within the wrapping materials can vary. Typical packing densities for tobacco rods of cigarettes of the present invention range from about 150 to about 300 mg/cm$^3$. Normally, packing densities of the tobacco rods range from about 200 to about 280 mg/cm$^3$.

The paper wrapping material which is further processed to provide a wrapping material of the present invention can vary. Such a wrapping material includes a cellulosic base web, and most preferably an essentially water insoluble (e.g., an inorganic) filler material. The cellulosic base web can be provided from flax fibers, wood pulp (e.g., hardwood pulp and softwood pulp), esparto fibers, sisal fibers, or other cellulosic material. Mixtures of 2 or more types of cellulosic materials can be employed. If desired, the cellulosic base web also can include tobacco parts or pieces (e.g., tobacco stem parts), extracted tobacco parts or pieces (e.g., tobacco pulp), or bleached tobacco parts or pieces. The filler material is an essentially water insoluble material, most preferably is an inorganic filler material, and can include particles of calcium carbonate, precipitated magnesium hydroxide gel, magnesium oxide particles, calcium sulfate fibers, agglomerated calcium carbonate particles, and the like. Exemplary filler materials suitable for use in paper manufacture are set forth in U.S. Pat. application Ser. No. 567,521, filed Aug. 15, 1990. Preferred wrapping materials include flax fiber/calcium carbonate, wood pulp/calcium carbonate, and flax fiber/wood pulp/calcium carbonate. Certain wrapping materials, particularly those incorporating calcium carbonate filler material, are essentially absent of magnesium-containing filler material (e.g., the wrapping material includes less than about 1, preferably less than about 0.5 percent of a magnesium-containing filler material, such as magnesium oxide or magnesium hydroxide). Methods for manufacturing suitable paper wrapping materials will be apparent to the skilled artisan.

The wrapping material which is further processed to provide the wrapping material of the present invention can have a wide range of compositions and properties. Typical paper wrapping materials include about 55 to about 100, often about 65 to about 95, and frequently about 70 to about 90 percent cellulosic material; and about 0 to about 45, often about 5 to about 35, and frequently about 10 to about 30 percent inorganic filler material; based on the dry weight of the paper. The basis weight of the paper can vary. Typical dry basis weights are at least about 15, and frequently are at least about 20 g/m$^2$; while typical basis weights do not exceed about 80, and frequently do not exceed about 60 g/m$^2$. The porosity of the paper can vary. Typical papers have inherent permeabilities which are less than about 300 CORESTA units, often are less than about 150 CORESTA units, frequently are less than about 75 CORESTA units, and usually are less than about 50 CORESTA units. By the term "inherent permeability" is meant the air flow porosity of the paper itself.

Exemplary wrapping materials are available as Ref. Nos. 419, 454, 455, 456, 719, 754, 854, 855 and 856 from Ecusta Corp.; P-3284-29, P-3284-28, P-3284-30, and P-3169-5B from Kimberly-Clark Corp. Other exemplary wrapping materials, though not preferred, are available as Ecusta Experimental Paper Nos. TOD 05504, TOD 05405, TOD 05273, TOD 05275, TOD 05375, TOD 05759, TOD 05721, TOD 05560, TOD 05505, TOD 05386, TOD 05390, TOD 05422, TOD 05387, TOD 05551, TOD 05151, TOD 05365, TOD 05992, TOD 05962, TOD 05963, TOD 05969, TOD 05943, TOD 06202 and TOD 06235 from Ecusta Corp. Preferably, such wrapping materials are employed as the outer wrapping material of those tobacco rods having two layers of wrapping materials; however, such wrapping materials also can be employed as inner wrapping materials of those tobacco rods having two layers of wrapping materials.

The additive package includes at least one water soluble alkali earth metal ion component. Examples of such a component are calcium ions, magnesium ions, and mixtures of calcium and magnesium ions. Typically, such a component is provided as at least one water soluble salt. Salts of alkali earth metal ion components and organic anion components are particularly preferred, although salts of alkali earth metal ion components and inorganic anion components also can be employed. Exemplary salts include magnesium acetate, calcium acetate, magnesium propionate, calcium propionate, magnesium formate, calcium formate, magnesium chloride, calcium chloride, magnesium nitrate, calcium nitrate, and the like. Mixtures of 2 or more salts can be employed.

The additive package most preferably includes at least one water soluble alkali metal ion component. Examples of such a component are sodium ions and potassium ions, and mixtures of sodium and potassium ions. Typically, such a component is provided as at least one water soluble salt. Salts of alkali metal ion components and organic anion components, as well as salts of alkali metal ion components and inorganic anion components, can be employed. Exemplary salts include potassium chloride, sodium citrate, sodium chloride, sodium phosphate, potassium nitrate, potassium lactate, potassium gluconate, sodium nitrate, potassium acetate, sodium acetate, potassium borate, sodium borate, potassium malate, potassium citrate, potassium succinate, potassium propionate, and the like. Preferably, potassium ion components are particularly preferred. Mixtures of 2 or more salts can be employed.

The additive package includes at least one water soluble organic anion component. Particularly desirable are those organic anions that, when present in a treated wrapping material as calcium or magnesium salts, have the capability to thermally decompose at those temperatures experienced during the smoking period of a cigarette to form a calcium carbonate or magnesium oxide, respectively. Exemplary organic anions include acetate, propionate, formate and lactate ions. Mixtures of different organic anions can be employed.

The additive package preferably includes at least one water soluble inorganic anion component. Exemplary inorganic anions include chloride, sulfate, nitrate, phosphate and borate ions. Mixtures of different inorganic anions can be employed.

The manner in which the additive package is applied to, incorporated into, or otherwise provided in intimate contact with the paper can vary. Most preferably, the additive package is incorporated into the paper after the paper manufacturing process (i.e., the paper is post-treated with the additive package). In particular, the additive package can be applied to manufactured paper using size press techniques, spraying techniques, painting techniques, rotogravure techniques, printing techniques, flood roller techniques, immersion techniques, or the like. Such techniques will be apparent to the skilled artisan. The additive package can be applied to one or both sides of the paper in a patterned manner; applied uniformly to one or both sides of the paper; or incorporated essentially throughout the paper, preferably in a uniform manner. Uniform distribution of components throughout the paper is desirable, in order that the additive package can provide a sealant character to the paper so as to provide desirable ash forming properties. The components of the additive package can be incorporated into the paper simultaneously or individually at different processing stages. Preferably, a very concentrated aqueous solution (e.g., a near saturated solution) of at least one salt is applied to the paper. Normally, the components of the additive package are dissolved in water, applied as an aqueous solution to the paper, and then the paper is dried to provide the component salts in intimate contact with the resulting treated paper. Alternatively, an organic acid (e.g., acetic acid) can be combined with an alkali earth metal ion-containing salt (e.g., magnesium sulfate) in water for application to the paper. A mixture of salts which would otherwise form precipitates if mixed together in water can be applied to the paper individually as components of separate aqueous solutions. As one example, an aqueous solution of calcium acetate, magnesium propionate and potassium chloride can be applied to the paper; the paper can be dried; then an aqueous solution of potassium malate and potassium citrate can be applied to (e.g., sprayed onto) the paper; and the paper can be dried. As another example, an aqueous solution of potassium carbonate can be applied to the paper; the paper can be dried; then an aqueous solution of calcium acetate and calcium chloride can be applied to the paper; and the paper can be dried. As yet another example, an aqueous solution of calcium acetate can be applied to the paper; the paper can be dried; then an aqueous solution of potassium carbonate can be applied to the paper; the paper can be dried; then an aqueous solution of calcium acetate and calcium chloride can be applied to the paper; and the paper can be dried. Treated papers can be dried in a variety of ways (e.g., by air drying techniques, or by conductive or convective heating techniques, such as using drum dryers or tunnel dryers).

The amount of additive package remaining in intimate contact with the treated or finished wrapping material can vary. The amount of additive package within the finished paper typically is such that the package provides at least 5, normally at least about 10, often at least about 15, and frequently at least about 20 percent of the dry weight of the finished pap However, the amount of additive package within the finished paper normally provides up to about 40, often up to about 35, and frequently up to about 30 percent of the dry weight of the finished paper. Relatively high levels of additive package (e.g., about 30 percent or more, based on the dry weight of the finished paper) can be employed when the level of inorganic filler material of the paper is relatively low (e.g., less than about 10 percent, based on the weight of the paper prior to treatment). Wrapping materials treated with the additive package according to the present invention typically exhibit a significant increase in basis weight as compared to the untreated wrapping material. Preferably, the majority by weight of the components of the additive package remain in water soluble form (i.e., as water soluble salts) while those components are in intimate contact with the wrapping material, during the useful lifetime of the wrapping material. For example, more than about 50, preferably more than about 75, and most preferably more than about 90 weight percent of the additive package remains in a water soluble salt form during the useful lifetime of the wrapping material.

The amount of individual components of the additive package relative to one another can vary. A highly preferred additive package includes (i) optional alkali metal ions and (ii) alkali earth metal ions, such that the ratio of equivalents of (i) to (ii) ranges from about 0 to about 1.2, typically about 0.05 to about 1, often about 0.1 to about 0.7, and frequently about 0.2 to about 0.5. A highly preferred additive package also includes (iii) optional inorganic anions and (iv) organic anions, such that the ratio of equivalents of (iii) to (iv) ranges from about 0 to about 1, typically about 0.05 to about 0.7, often about 0.1 to about 0.5, and frequently about 0.1 to about 0.3. In addition, for an additive package, the total number of equivalents of (i) plus (ii) equals the total number of equivalents of (iii) plus (iv). Although the additive package can be absent of, or essentially absent of, alkali metal ion and/or inorganic anion components (i.e., those components are optional), it is highly preferred that one or both of those components be present as part of the additive package. For preferred additive packages, the ratio of equivalents of (i) to (ii) is less than about 0.5, and most preferably is less than about 0.4; and the ratio of equivalents of (iii) to (iv) is less than about 0.5, and most preferably less than about 0.4.

The various components of the additive package provide various characteristics to the wrapping material to which the package is applied. Certain components of the package can act as ash formers, and hence provide for a good quality, uniform ash. Certain components can act as burn chemicals (e.g., as burn inhibitors, burn retardants or burn accelerators) in order to control the burn rate of the cigarette, and hence provide the desired puff count and provide a cigarette which exhibits a propensity to not self-extinguish. Certain components can act as ash conditioners or ash sealers.

The wrapping material having the additive package in intimate contact therewith most preferably is a cigarette wrapping material having a moderate to low inherent air permeability value. For example, such wrapping materials having the additive package incorporated therein have inherent air permeabilities (i.e., the air flow porosity of the treated paper itself) of less than about 30 CORESTA units, normally less than about 25 CORESTA units, generally less than about 20 CORESTA units, often less than about 15 CORESTA units, and frequently less than about 10 CORESTA units.

The wrapping material having the additive package in intimate contact therewith, and in particular a wrapping material having a relatively low inherent permeability, can be processed in order to have a relatively high net permeability (e.g., a net permeability above about 40, and preferably above about 50 CORESTA units). By the term "net permeability" is meant the air flow porosity of the wrapping material as used in manufacturing the tobacco rod. Typically, the air permeability is provided to the wrapping material using micro laser, mechanical or electrostatic perforation techniques. During micro laser and electrostatic perforation operations, it is most desirable that care be taken to maintain the desired color and opacity of the paper. For example, it is most desirable to minimize or avoid an unsightly "browning" or singeing of the paper. For example, such wrapping materials having low inherent permeabilities can be perforated using conventional electrostatic perforating techniques (e.g., to provide individual perforations comparable in size to conventional electrostatically provided perforations) to obtain a wrapping material having a net porosity of from about 50 to about 225 CORESTA units, preferably from about 80 to about 180 units, more preferably from about 90 to about 120 CORESTA units.

The sizes of the individual perforations which provide for the high net permeabilities to such wrapping materials generally are such that the perforations are larger than the pores which are present in the naturally occurring paper wrapping material (i.e., which provide the inherent permeability to the paper). For aesthetic purposes, the individual perforations preferably are small enough to not be unsightly. For example, the perforations are not particularly noticeable, and in most instances are barely visible to the naked eye.

If desired, flavoring agents and/or flavor and aroma precursors (e.g., vanillin glucoside and/or ethyl vanillin glucoside) also can be incorporated into the paper wrapping material having the additive package incorporated therein. See, U.S. Pat. No. 4,941,486 to Dube, et al., which is incorporated herein by reference. Other additives, such as acids, can be applied to the wrapping material in combination with or in addition to the additive package. Exemplary acids include malic acid, levulinic acid, boric acid, lactic acid, and the like. Certain acids can be incorporated into the wrapping material by combining a slight excess of acid with a corresponding base when the additive package is being formulated.

The inner wrapping material of certain tobacco rods of certain cigarettes of the present invention is a paper, and most preferably is a paper which comprises tobacco material. A certain amount of inorganic filler material (e.g., calcium carbonate) and/or a water soluble salt (e.g., potassium citrate) most preferably is incorporated into the inner wrapping material. The inner wrapping material also can include a carbonaceous material. The inherent permeability of the inner wrapping material can vary, but usually is higher than the inherent permeability of the outer wrapping material, and frequently is quite high relative to the outer wrapping material. Normally, the ultimate inherent permeability provided by the combined wrapping materials is slightly less than that inherent permeability of the outer wrapping material; however, effects of the inner wrapping material towards lowering the ultimate inherent permeability of the combined wrapping materials are less in instances in which the differences between the inherent permeabilities of the inner and outer wrapping materials are relatively great. Generally, the inherent permeability of the inner wrapping material is above about 10 CORESTA units, often above about 50 CORESTA units, and frequently is above about 100 CORESTA units, although the permeability of that wrapping material can approach 1,000 CORESTA units. The inner wrapping material can be perforated (e.g., electrostatically perforated) to provide the desired net permeability.

Various inner wrapping materials can be employed. One type of inner wrapping material is described in U.S. Pat. application Ser. No. 833,193 filed Feb. 6, 1992. Certain other tobacco-containing inner wrapping materials are described in U.S. Pat. application Ser. Nos. 661,747, filed Feb. 27, 1991, and 759,266, filed Oct. 3, 1991, which are incorporated herein by reference. One wrapping material is available as P-2540-94-A from Kimberly-Clark Corp.; which is a paper containing about 29 weight percent particles of activated charcoal provided from coconut hulls and about 71 weight percent tobacco parts, and having a permeability of about 250 CORESTA units. Another wrapping material is available as P-2540-94-C from Kimberly-Clark Corp.; which is a paper containing about 40 weight percent particles of activated charcoal provided from coconut hulls and about 60 weight percent tobacco parts, and having a permeability of about 350 CORESTA units. Another wrapping material is available as P-2540-94-D from Kimberly-Clark Corp.; which is a paper containing about 50 weight percent particles of activated charcoal provided from coconut hulls and about 50 weight percent tobacco parts, and having a permeability of about 380 CORESTA units. Another wrapping material is available as P-2540-136-C from Kimberly-Clark Corp.; which is a paper made from wood pulp, flue-cured and Burley tobacco stems and carbonized hardwood particles, and has a basis weight of about 47 g/m$^2$ and an inherent permeability of about 14 CORESTA units. Another wrapping material is available as P-3122-4-4 from Kimberly-Clark Corp.; which is a paper made from about 20 weight percent wood pulp, about 30 weight percent Turkish tobacco strip, about 30 weight percent "American blend" in cut filler form and about 20 weight percent calcium carbonate particles, and is electrostatically perforated to a net permeability of about 150 CORESTA units. Another wrapping material is available as P-2831-189-AA4 from Kimberly-Clark Corp.; which is a paper made from 20 weight percent wood pulp, about 30 weight percent Turkish tobacco strip, about 30 weight percent "American blend" in cut filler form and about 20 weight percent calcium carbonate particles, and has a basis weight of about 60 g/mand an inherent permeability of about 125 CORESTA units. Another wrapping is available as P-3284-11 from Kimberly-Clark Corp., which is a paper made from 25 weight percent wood pulp, about 66 weight percent Turkish tobacco strip and about 9 weight percent calcium carbonate particles, and has a basis weight of about 60 g/m$^2$ and an inherent permeability of about 50 CORESTA units. Other wrapping materials include carbonaceous material, wood pulp and tobacco stem parts; have porosities between about 60 and about 150 CORESTA units; have basis weights between about 45 g/m$^2$ and about 70 g/m$^2$; and are available as P-2540-107-A, P-2540-107-B, P-2540-107-C and P-2540-107-D from Kimberly-Clark Corp. Other materials are available as P-2249-115, P-2674-157, P-2540-155, P-2540-136-D, P-2540-136-E, P-2540-152, P-2540-150, P-2540-157, P-2540-151, P-2540-156, P-2831-197-A10, P-2540-94-A, P-144-KC-G, P-144-RB, P-144-KCL, P-144-SN20, P-144-BHC, P-2674-157-A5116, P-2674-157-A5116, P-2831-130, P-2831-22-1, P-2831-23-3, P-1976-25-1, P-1976-25-2, P-2540-191, P-2540-192, P-2540-193, P-2540-194, P-2540-195, P-2540-196, P-1976-25-3, P-2831-189-B1-6606, P-3284-14, P-3284-14-1, P-3284-14-2, P-3284-14-3, P-3284-196, P-2831-189-B2-6608 and P-2831-189-B3-6609 from Kimberly-Clark Corp. Although less preferred from a manufacturing standpoint, the inner wrap also can be a reconstituted tobacco material of the type described in U.S. Pat. Nos. 4,962,774 to Thomasson, et al. and 4,987,906 to Young, et al. and U.S. Pat. application Ser. No. 710,273, filed Jun. 4, 1991.

The most preferred inner wrapping materials are tobacco containing papers. Tobacco containing papers are made from tobacco parts (e.g., tobacco stems, tobacco fines, pieces of tobacco stems, tobacco dust, tobacco cut filler, tobacco strip, tobacco leaf, processed tobacco stems, tobacco scrap, extracted tobacco pulp, and/or tobacco extracts). Preferred tobacco containing papers include the cellulosic portion of the tobacco material, and also can include one or more tobacco extracts. As such, preferred tobacco containing papers incorporate tobacco as a cellulosic component. The inner wrapping materials also can have cellulosic materials (e.g., wood pulp), as well as additive water soluble salts and additive inorganic fillers (e.g., calcium carbonate and/or magnesium hydroxide) incorporated therein. Methods for manufacturing such papers will be apparent to the skilled artisan.

Typically, the filter element has a length which ranges from about 15 mm to about 40 mm, preferably about 20 mm to about 35; and a circumference of about 17 mm to about 27 mm, preferably about 22 mm to about 25 mm. The filter element can have a wide range of filtration efficiencies. The filter element can have one segment of filter material, two or more longitudinally positioned segments, or other configurations. Exemplary filter materials include cellulose acetate tow, cellulose acetate web, non-woven polypropylene web and non-woven polyester web. The filter material can be plasticized (e.g., using triacetin). Exemplary filter elements are described in U.S. Pat. application Ser. Nos. 661,747, filed Feb. 27, 1991, and 759,266, filed Oct. 3, 1991, which are incorporated herein by reference.

Typically, the tipping material circumscribes the filter element and an adjacent region of the tobacco rod such that the tipping material extends about 3 mm to about 6 mm along the length of the tobacco rod. Typically, the tipping material is a conventional paper tipping material and is adhesively secured to the filter element and the adjacent region of the tobacco rod. The tipping material can have a permeability which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

For air diluted or ventilated cigarettes of the present invention, the amount of air dilution can vary. Often, the amount of air dilution for an air diluted cigarette is greater than about 10 percent, and frequently greater than about 25 percent. The upper limit of air dilution for a cigarette typically is less than about 75 percent, more frequently less than about 65 percent.

Cigarettes of the present invention exhibit a desirably high resistance to draw. For example, cigarettes of this invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of this invention preferably exhibit resistance to draw values of about 70 to about 180, more preferably about 80 to about 150 mm water pressure drop at 17.5 cc/sec. air flow.

Cigarettes of the present invention, when smoked, generally yield less than about 20 mg, preferably less than about 10 mg of sidestream "tar" per cigarette, as determined using the apparatus and techniques described by Proctor, et al., Analyst, Vol. 113, p. 1509 (1988). Such cigarettes normally provide more than about 6 puffs, preferably more than about 8 puffs per cigarette when smoked under FTC conditions. FTC conditions consist of 35 ml puffs of 2 second duration separated by 58 seconds of smolder. Normally, cigarettes of the present invention provide less than about 15 puffs, and often less than about 12 puffs, when smoked under FTC conditions. Normally, cigarettes of the present invention yield less than about 2 mg, preferably less than about 1.5 mg, and most preferably less than about 1 mg of sidestream "tar" per 1 minute puff cycle period, when smoked under FTC conditions.

A cigarette of the present invention, when smoked, is capable of yielding an ash and firecone which are acceptable. The preferred ash is not overly dark in color, is not easily dislodged from the cigarette, and is not flaky. The firecone is of acceptable length, is not overly cohesive, and is not overly fragile (i.e., the ash maintains its integrity). However, preferred cigarettes yield a fairly cohesive ash having a minimal amount of fractures and fissures, and yield a fairly continuous phase ash as provided by the wrapping material of the present invention. Preferred cigarettes yield an ash which exhibits a propensity to "fuse" to the ash of the tobacco column, and hence exhibit a tendency to be supported by the tobacco column ash.

Cigarettes of the present invention exhibit a tendency to maintain smolder under static burning conditions (i.e., without puffing after the lighting puff) and do not exhibit a propensity to self-extinguish. Much preferred cigarettes maintain smolder for at least about 3 minutes, more preferably at least about 5 minutes, and often at least about 7 minutes, without self-extinguishing. Preferred cigarettes are such that at least about one third of the burnable length of the tobacco rod, often at least about one half of the burnable length of the tobacco rod, and frequently the total burnable length of the tobacco rod is consumed during static burning conditions without self-extinguishing.

Cigarettes of the present invention burn at an acceptable rate during smoking, particularly under free smolder (i.e., static burning) conditions. Typical cigarettes of the present invention, and particularly those cigarettes having a circumference of about 24 mm to about 25 mm, exhibit a static tobacco rod linear burn rate of less than about 6 mm/min.

Cigarettes of the present invention generally provide FTC "tar" yields in the range from about 2 to about 14 mg/cigarette, although other "tar" yields are possible. Typical FTC carbon monoxide to FTC "tar" ratios for such cigarettes are less than about 2, and sometimes are less than about 1.8. Cigarettes of the present invention exhibit desirable organoleptic properties. Cigarettes having magnesium ions as a component of the additive package have a tendency to provide mainstream smoke having relatively low sour flavor characteristics, tend to produce a white ash, and tend to produce a narrow char line having a desirable color and shape. Cigarettes having calcium ions as component of additive package have a tendency to provide mainstream smoke which does not exhibit an overly chalky flavor.

The following examples are provided in order to further illustrate the invention but should not be construed as limiting the scope thereof. Unless otherwise noted, all parts and percentages are by weight.

EXAMPLE 1

Cigarettes substantially as shown in FIG. 1 are prepared as follows:

The cigarettes each have a length of about 84 mm and a circumference of about 24.8 mm, and include a tobacco rod having a length of 57 mm and a filter element having a length of about 27 mm. The tobacco rod includes a smokable blend circumscribed by a layer of wrapping material which is in turn circumscribed by a second or outer wrapping material. Each filter element is available as TSS 4198 from FIL International, Ltd. Each filter element is attached to each tobacco rod using nonporous tipping paper. For each cigarette, the tipping paper circumscribes the filter element and about a 4 mm length of the tobacco rod in the region adjacent the filter element. The filter elements are ventilated to about 45 percent air dilution by providing a ring of mechanical perforations around the paper wrapping materials of the filter element about 13 mm from the extreme mouthend of the cigarette.

The smokable blend of the tobacco rod consists of tobacco material which has been cased with a casing mixture. The tobacco material has the form of a so-called "American blend," and includes flue-cured, Burley and Oriental tobaccos as well as reconstituted tobacco from a paper-making process, and volume expanded flue-cured and Burley tobaccos. The blend of tobacco materials is cased using a mixture of glycerin, water and flavors. The blend is in the form of strands or shreds cut at about 25 cuts per inch (i.e., in cut filler form) and is equilibrated to a moisture level of about 12.5 percent. Each cigarette rod includes about 650 mg tobacco material.

The second or outer wrap is a treated paper. The paper which is treated comprises about 12 parts wood pulp, about 1 part flax fibers and about 6 parts calcium carbonate filler prior to treatment. The paper includes less than 1 percent of a mixture of sodium citrate and potassium citrate prior to treatment. The paper which is treated is available as Ref. No. 456 from Ecusta Corp. The paper has a measured basis weight of about 24.7 g/m$^2$, and a measured porosity of about 22 CORESTA units. The paper is treated with an aqueous solution comprising about 20 parts calcium acetate, about 3 parts potassium acetate, about 3 parts potassium chloride and about 74 parts water. The solution is applied to the paper wrap by immersing the wrap in the solution at ambient temperature so as to saturate that paper with the solution. The paper is removed from the solution, pressed to remove excess solution, dried at about 80° C. to about 90° C. on a curved top sheet dryer, and conditioned under ambient conditions for about 4 hours. After conditioning, the paper exhibits a basis weight of 33 g/m$^2$ and a porosity of 7.9 CORESTA units. The final outer wrap includes about 75 parts calcium carbonate, wood pulp and flax fiber; and about 25 parts of a mixture of calcium, acetate, potassium and chloride ions provided by the additive package.

The first or inner cigarette paper wrap is available as P-2831-130 from Kimberly-Clark Corp. The paper wrap includes tobacco parts, wood pulp and calcium carbonate particles. The inner paper wrap is absent of added burn chemical in the form of added water soluble salt. The paper is light brown in color, has a somewhat rough surface texture, and exhibits an inherent permeability of about 50 CORESTA units.

The tobacco rod is such that the inner wrap circumscribes the smokable blend and the outer wrap circumscribes the inner wrap. The inner and outer wraps directly contact one another (i.e., the inner surface of the outer wrap contacts the outer surface of the inner wrap).

Exemplary cigarettes are made using the treated outer wrap and the inner wrap. Comparison cigarettes are made using untreated Ref. No. 456 paper and the inner wrap.

The cigarettes are employed by burning the tobacco rod such that the blend of smokable material within the paper wrapper burns to yield smoke. When employed, the exemplary cigarettes yield very low levels of visible sidestream smoke and sustain smolder under static burning conditions after the lighting puff such that the total burnable length of the tobacco rod is consumed (i.e., the cigarette does not self-extinguish).

The cigarettes are smoked under FTC smoking conditions, and the exemplary cigarette yield 11 puffs, while the comparison cigarette yields 10 puffs. The cigarettes are also tested for sidestream smoke production by optical indication of smoke collected in a box during smoking of cigarettes under FTC smoking conditions. Sidestream absorbance values are determined after 6 puffs using the method described in U.S. Pat. No. 4,589,775 to Milhouse, Jr. et al. The sidestream absorbance value for the comparison cigarette is 0.3696, while that for the exemplary cigarette is 0.1864.

EXAMPLE 2

Cigarettes are provided essentially as described in Example 1; however, the outer wrap is treated with an aqueous solution comprising about 30 parts calcium acetate, about 2 parts potassium acetate, about 3 parts potassium chloride and about 86 parts water using techniques essentially as described in Example 1. The treated outer wrap exhibits a basis weight of about 32.8 g/m$^2$ and a porosity of about 10 CORESTA units. The final outer wrap includes about 75 parts calcium carbonate, flax and wood pulp; and about 25 parts of the additive package of calcium, potassium acetate, and chloride ions provided by the additive package of calcium acetate, potassium acetate and potassium chloride.

The cigarettes are smoked and tested as described in Example 1, and yield 10.7 puffs and yield a sidestream absorbance value of 0.1972.

EXAMPLE 3

Cigarettes are provided essentially as described in Example 1; however, the inner wrap is available as P-3284-14 from Kimberly-Clark Corp., and the outer wrap is provided as follows:

A paper wrapping material comprises calcium carbonate and wood pulp, and is available as P-3284-28 from Kimberly-Clark Corp. The paper is treated with an aqueous solution comprising about 25 parts calcium acetate, about 3 parts potassium acetate, and 3 parts potassium chloride and about 86 parts water, using techniques essentially as described in Example 1. The treated outer wrap includes about 22 parts calcium, potassium, acetate and chloride ions provided by the additive package.

EXAMPLE 4

Cigarettes are provided essentially as described in Example 3; however, the outer wrap is treated with an aqueous solution comprising about 3 parts potassium acetate, about 3 parts potassium chloride, about 34.5 parts magnesium acetate tetrahydrate and about 85 parts water.

EXAMPLE 5

Cigarettes are provided essentially as described in Example 3; however, the outer wrap is treated with an aqueous solution comprising about 10 parts calcium acetate, about 20 parts magnesium acetate tetrahydrate, about 3 parts potassium acetate, about 3 parts potassium chloride and about 85 parts water.

EXAMPLE 6

Cigarettes are provided essentially as described in Example 3; however, the outer wrap is treated with an aqueous solution comprising about 12 parts calcium acetate, about 18 parts magnesium acetate tetrahydrate, about 3 parts potassium acetate, about 3 parts potassium chloride and about 85 parts water.

EXAMPLE 7

Cigarettes are provided essentially as described in Example 3; however, the outer wrap is treated with an aqueous solution comprising about 13 parts calcium acetate, about 15 parts magnesium acetate tetrahydrate, about 3 parts potassium chloride, about 3 parts potassium chloride and about 85 parts water.

EXAMPLE 8

Cigarettes are provided generally as described in Example 1; however, the inner wrap is available as P-3284-14-3 from Kimberly-Clark Corp., and the outer wrap is provided as follows:

A solution comprising about 29 parts calcium acetate, about 3.5 parts potassium acetate, about 3.5 parts potassium chloride and about 109 parts of water is applied to a paper wrapping material available as Ref. No. 456 from Ecusta Corp. The solution is applied to the paper as a coating using an 85 Quad Cylinder on a Faustel Laminator. The treated, finished paper includes about 19 percent calcium, potassium, chloride and acetate ions provided by the additive package.

EXAMPLE 9

Cigarettes are provided as described in Example 8; however, the outer wrap is treated with an aqueous solution comprising 25.8 parts magnesium acetate tetrahydrate, 9.4 parts calcium acetate, 4.2 parts potassium acetate, about 4.2 parts potassium chloride and about 102 parts water. The treated, finished paper includes about 18 percent calcium, magnesium, potassium, chloride and acetate ions provided by the additive package.

EXAMPLE 10

Cigarettes are provided essentially as described in Example 3; however, the outer wrap is provided as follows:

A paper wrapping material available as P-3169-5B from Kimberly-Clark Corp. includes wood pulp and a very low level of inorganic filler material (e.g., less than about 5 percent calcium carbonate filler material). The paper exhibits a measured basis weight of about 19 $g/m^2$ and a porosity of about 28 CORESTA units. The paper is treated with an aqueous solution comprising about 10 parts calcium acetate, and about 20 parts magnesium acetate tetrahydrate, about 3 parts potassium acetate, about 3 parts potassium chloride and about 85 parts water. The treated outer wrap includes about 20 parts calcium, magnesium, potassium, chloride and acetate ions provided by the additive package. The treated paper is dried, and exhibits a basis weight of about 22 $g/m^2$ and a porosity of about 14 CORESTA units.

EXAMPLE 11

Cigarettes are provided essentially as described in Example 3; except that the outer wrap is provided as follows:

A paper wrapping material available as TOD 06235 from Ecusta Corp. is treated with an aqueous solution comprising about 5 parts calcium acetate, about 8 parts magnesium acetate tetrahydrate, about 2 parts potassium acetate, about 3 parts potassium chloride and about 85 g water, using techniques essentially as described in Example 1. The treated outer wrap includes about 10 parts calcium, magnesium, potassium, acetate and chloride ions provided by the additive package.

EXAMPLE 12

Cigarettes are provided essentially as described in Example 9; however, the inner wrap is available as TOD 06235 from Ecusta Corp.

EXAMPLE 13

Cigarettes are provided essentially as described in Example 9; however, the inner wrap is provided as follows:

A paper wrapping material available as TOD 06235 from Ecusta Corp. is treated with an aqueous solution comprising about 5 parts calcium acetate, about 8 parts magnesium acetate tetrahydrate, about 2 parts potassium acetate, about 3 parts potassium chloride and about 74 parts water, using techniques essentially as described in Example 1. The treated inner wrap includes about 10 parts calcium, magnesium, potassium, acetate and chloride ions provided by the additive package.

EXAMPLE 14

A paper available as P-3122-14 from Kimberly-Clark Corp. includes about 30 parts calcium chloride, and that paper is treated with an aqueous solution comprising 15 parts potassium carbonate and about 85 parts water using a flooded nip roller technique. The treated paper is dried at about 80° C. to about 90° C. using a curved top sheet dryer. The treated paper includes significant inclusion of calcium carbonate, and the calcium carbonate is distributed to a greater degree towards the "felt side" of the paper.

EXAMPLE 15

A cigarette substantially as shown in FIG. 1 and having only one layer of circumscribing wrapping material surrounding the smokable material is provided essentially as described in Example 1. The wrapping material is available as Ref. No. 456 from Ecusta Corp. and is treated as described in Example 1 by immersing that wrapping material into an aqueous solution comprising about 12 parts calcium acetate, about 2 parts potassium acetate and about 86 parts water. The resulting treated paper includes about 85.5 parts calcium carbonate, wood pulp and flax fiber; and about 14.5 parts of a mixture of calcium, acetate and potassium ions provided by the additive package.

The exemplary cigarette having the treated wrapping material and a comparison cigarette (i.e., a similar cigarette including untreated Ref. No. 456 paper) are treated for sidestream smoke production using the techniques described in Example 1. The sidestream smoke absorbance value for the comparison cigarette is 0.6716, while that for the exemplary cigarette is 0.5243.

What is claimed is:

1. A cigarette comprising a rod of smokable material contained in a circumscribing paper wrapping material in intimate contact with an additive package, the paper wrapping material comprising a cellulosic base web and an additive package including water soluble components, which additive package
   (a) provides about 5 to about 40 percent of that paper wrapping material on a dry weight basis; and
   (b) includes (i) alkali metal ions and (ii) alkali earth metal ions, such that the ratio of equivalents of (i) to (ii) ranges from about 0.05 to about 1; and (iii) inorganic anions and (iv) organic anions, such that the ratio of equivalents of (iii) to (iv) ranges from about 0.05 to about 0.7; the equivalents of components (i) plus (ii) being equal to the equivalents of components (iii) plus (iv).

2. The cigarette of claim 1 wherein the paper wrapping material includes a cellulosic base web and at least one inorganic filler material.

3. The cigarette of claim 2 wherein the cellulosic base web comprises wood pulp and flax fibers.

4. The cigarette of claim 2 wherein the inorganic filler material includes calcium carbonate.

5. The cigarette of claim 2 wherein the paper wrapping material, absent of the additive package, includes about 65 to about 95 percent cellulosic material and about 5 to about 35 percent inorganic filler material, on a dry weight basis.

6. The cigarette of claim 2 wherein the organic filler material consists essentially of calcium carbonate.

7. The cigarette of claim 4 wherein the additive package includes magnesium ions.

8. The cigarette of claim 1 or 2 wherein the additive package includes a mixture of magnesium ions and calcium ions.

9. The cigarette of claim 8 wherein the additive package includes potassium ions.

10. The cigarette of claim 1 or 2 wherein the additive package includes potassium ions.

11. The cigarette of claim 1 or 2 wherein the additive package includes chloride ions.

12. The cigarette of claim 1 or 2 wherein the additive package includes acetate ions.

13. The cigarette of claim 1 or 2 wherein more than 75 weight percent of the additive package in intimate contact with the paper wrapping material has a water soluble form.

14. The cigarette of claim 1 or 2 wherein the organic anions are acetate ions, propionate ions, formate ions or lactate ions.

15. The cigarette of claim 1 or 2 wherein the additive package includes calcium, potassium, acetate and chloride ions.

16. The cigarette of claim 1 or 2 wherein the inorganic anions are chloride ions, sulfate ions, nitrate ions, phosphate ions or borate ions.

17. The cigarette of claim 1 or 2 wherein alkali earth metal ions include calcium ions.

18. The cigarette of claim 1 or 2 wherein the paper wrapping material comprising the additive package exhibits an inherent porosity of less than about 30 CORESTA units.

19. The cigarette of claim 1 or 2 wherein the additive package provides about 10 to about 35 percent of the dry weight of the paper wrapping material.

20. The cigarette of claim 1 or 2 wherein the additive package provides about 15 to about 30 percent of the dry weight of the paper wrapping material.

21. The cigarette of claim 1 or 2 wherein the additive package is such that the ratio of equivalents of (i) to (ii) ranges from about 0.2 to about 0.5; and the ratio of equivalents of (iii) to (iv) ranges from about 0.1 to about 0.3.

22. The cigarette of claim 1 or 2 wherein the smokable material is circumscribed by a further wrapping material, and the further wrapping material is circumscribed by the paper wrapping material.

23. The cigarette of claim 22 wherein the further wrapping material includes cellulosic material and at least one inorganic filler material.

24. The cigarette of claim 23 wherein the inorganic filler material of the further wrapping material includes calcium carbonate.

25. The cigarette of claim 23 wherein the inorganic filler material of the further wrapping material includes magnesium hydroxide.

26. The cigarette of claim 22 wherein the paper wrapping material includes wood pulp as a cellulosic base web component, and calcium carbonate as an inorganic filler material component.

27. The cigarette of claim 22 wherein the paper wrapping material comprises at least one inorganic filler material which includes calcium carbonate.

28. The cigarette of claim 22 wherein the additive package provides about 10 to about 35 percent of the paper wrapping material on a dry weight basis.

29. The cigarette of claim 22 wherein the additive package provides about 15 to about 30 percent of the paper wrapping material on a dry weight basis.

30. The cigarette of claim 22 wherein the additive package is such that the ratio of equivalents of (i) to (ii) ranges from about 0.2 to about 0.5, and the ratio of equivalents of (iii) to (iv) ranges from about 0.1 to about 0.3

31. The cigarette comprising a rod of smokable material contained in a circumscribing paper wrapping material in intimate contact with an additive package, the paper wrapping material comprising a cellulosic base web and an additive package including water soluble components, which additive package (a) provides about 5 to about 40 percent of that paper wrapping material on a dry weight basis; and (b) includes (i) alkali earth metal ions; and (ii) inorganic anions and (iii) organic anions, such that the ratio of equivalents of (ii) to (iii) ranges from about 0.05 to about 0.7; the equivalents of component (i) being equal to the equivalents of components (ii) plus (iii).

32. The cigarette of claim 31 wherein the paper wrapping material includes a cellulosic base web and at least one inorganic filler material.

33. The cigarette of claim 32 wherein the cellulosic base web comprises wood pulp and flax fibers.

34. The cigarette of claim 32 wherein the inorganic filler material includes calcium carbonate.

35. The cigarette of claim 32 wherein the paper wrapping material, absent of the additive package, includes about 65 to about 95 percent cellulosic material and about 5 to about 35 percent inorganic filler material, on a dry weight basis.

36. The cigarette of claim 32 wherein the organic filler material consists essentially of calcium carbonate.

37. The cigarette of claim 31 or 32 wherein more than 75 weight percent of the additive package in intimate contact with the paper wrapping material has a water soluble form.

38. The cigarette of claim 31 or 32 wherein the organic anions are acetate ions, propionate ions, formate ions or lactate ions.

39. The cigarette of claim 31 or 32 wherein the inorganic anions are chloride ions, sulfate ions, nitrate ions, phosphate ions or borate ions.

40. The cigarette of claim 31 or 32 wherein alkali earth metal ions include calcium ions.

41. The cigarette of claim 31 or 32 wherein the additive package includes a mixture of magnesium ions and calcium ions.

42. The cigarette of claim 31 or 32 wherein the additive package includes chloride ions.

43. The cigarette of claim 31 or 32 wherein the additive package includes acetate ions.

44. The cigarette of claim 31 or 32 wherein the paper wrapping material comprising the additive package exhibits an inherent porosity of less than about 30 CORESTA units.

45. The cigarette of claim 31 or 32 wherein the additive package provides about 10 to about 35 percent of the dry weight of the paper wrapping material.

46. The cigarette of claim 31 or 32 wherein the additive package provides about 15 to about 30 percent of the dry weight of the paper wrapping material.

47. The cigarette of claim 31 or 32 wherein the additive package is such that the ratio of equivalents of (ii) to (iii) ranges from about 0.1 to about 0.3.

48. The cigarette of claim 31 or 32 wherein the smokable material is circumscribed by a further wrapping material, and the further wrapping material is circumscribed by the paper wrapping material.

49. The cigarette of claim 48 wherein the further wrapping material includes cellulosic material and at least one inorganic filler material.

50. The cigarette of claim 49 wherein the inorganic filler material of the further wrapping material includes calcium carbonate.

51. The cigarette of claim 49 wherein the inorganic filler material of the further wrapping material includes magnesium hydroxide.

52. The cigarette of claim 48 wherein the paper wrapping material includes wood pulp as a cellulosic base web component, and calcium carbonate as an inorganic filler material component.

53. The cigarette of claim 48 wherein the paper wrapping material comprises at least one inorganic filler material which includes calcium carbonate.

54. The cigarette of claim 48 wherein the additive package provides about 10 to about 35 percent of the paper wrapping material on a dry weight basis.

55. The cigarette of claim 48 wherein the additive package provides about 15 to about 30 percent of the paper wrapping material on a dry weight basis.

56. The cigarette of claim 48 wherein the additive package is such that the ratio of equivalents of (ii) to (iii) ranges from about 0.2 to about 0.5.

57. A cigarette comprising a rod of smokable material contained in a circumscribing paper wrapping material in intimate contact with an additive package, the paper wrapping material comprising a cellulosic base web and an additive package including water soluble components, which additive package (a) provides about 5 to about 40 percent of that paper wrapping material on a dry weight basis; and (b) includes (i) alkali metal ions and (ii) alkali earth metal ions, such that the ratio of equivalents of (i) to (ii) ranges from about 0.05 to about 1; and (iii) organic anions; the equivalents of components (i) plus (ii) being equal to the equivalents of component (iii).

58. The cigarette of claim 57 wherein the paper wrapping material includes a cellulosic base web and at least one inorganic filler material.

59. The cigarette of claim 58 wherein the inorganic filler material includes calcium carbonate.

60. The cigarette of claim 58 wherein the paper wrapping material, absent of the additive package, includes about 65 to about 95 percent cellulosic material and about 5 to about 35 percent inorganic filler material, on a dry weight basis.

61. The cigarette of claim 57 or 58 wherein more than 75 weight percent of the additive package in intimate contact with the paper wrapping material has a water soluble form.

62. The cigarette of claim 57 or 58 wherein the organic anions are acetate ions, propionate ions, formate ions or lactate ions.

63. The cigarette of claim 57 or 58 wherein alkali earth metal ions include calcium ions.

64. The cigarette of claim 54 or 58 wherein the organic filler material consists essentially of calcium carbonate.

65. The cigarette of claim 57 or 58 wherein the additive package includes a mixture of magnesium ions and calcium ions.

66. The cigarette of claim 57 or 58 wherein the additive package includes potassium ions.

67. The cigarette of claim 57 or 58 wherein the paper wrapping material comprising the additive package exhibits an inherent porosity of less than about 30 CRESTA units.

68. The cigarette of claim 57 or 58 wherein the additive package provides about 10 to about 35 percent of the dry weight of the paper wrapping material.

69. The cigarette of claim 57 or 58 wherein the additive package provides about 15 to about 30 percent of the dry weight of the paper wrapping material.

70. The cigarette of claim 57 or 58 wherein the additive package is such that the ratio of equivalents of (i) to (ii) ranges from about 0.2 to about 0.5.

71. The cigarette of claim 57 or 58 wherein the smokable material is circumscribed by a further wrapping material, and the further wrapping material is circumscribed by the paper wrapping material.

72. The cigarette of claim 71 wherein the further wrapping material includes cellulosic material and at least one inorganic filler material.

73. The cigarette of claim 72 wherein the inorganic filler material of the further wrapping material includes calcium carbonate.

74. The cigarette of claim 71 wherein the inorganic filler material of the further wrapping material includes magnesium hydroxide.

75. The cigarette of claim 71 wherein the paper wrapping material includes wood pulp as a cellulosic base web component, and calcium carbonate as an inorganic filler material component.

76. The cigarette of claim 71 wherein the paper wrapping material comprises at least one inorganic filler material which includes calcium carbonate.

77. The cigarette of claim 71 wherein the additive package provides about 10 to about 35 percent of the paper wrapping material on a dry weight basis.

78. The cigarette of claim 71 wherein the additive package provides about 15 to about 30 percent of the paper wrapping material on a dry weight basis.

79. The cigarette of claim 71 wherein the additive package is such that the ratio of equivalents of (i) to (ii) ranges from about 0.2 to about 0.5.

* * * * *